US010974505B2

(12) United States Patent
Edamura et al.

(10) Patent No.: US 10,974,505 B2
(45) Date of Patent: Apr. 13, 2021

(54) PRINTING APPARATUS, PRINTING METHOD, AND STORAGE MEDIUM

(71) Applicant: CANON KABUSHIKI KAISHA, Tokyo (JP)

(72) Inventors: Tetsuya Edamura, Inagi (JP); Kentaro Muro, Tokyo (JP); Eiji Komamiya, Kawasaki (JP); Masashi Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/505,962

(22) Filed: Jul. 9, 2019

(65) Prior Publication Data

US 2020/0023639 A1 Jan. 23, 2020

(30) Foreign Application Priority Data

Jul. 17, 2018 (JP) ..... JP2018-134263

(51) Int. Cl.
*B41J 2/045* (2006.01)
*B41J 2/21* (2006.01)

(52) U.S. Cl.
CPC ..... *B41J 2/04595* (2013.01); *B41J 2/2121* (2013.01); *B41J 2/2146* (2013.01); *B41J 2202/21* (2013.01)

(58) Field of Classification Search
CPC .. B41J 2/04595; B41J 2/2121; B41J 2202/21; B41J 2/2146
See application file for complete search history.

(56) References Cited

U.S. PATENT DOCUMENTS

| | | | |
|---|---|---|---|
| 6,334,659 | B1 | 1/2002 | Maeda et al. |
| 6,364,446 | B1 | 4/2002 | Ishikawa et al. |
| 6,572,212 | B2 | 6/2003 | Konno et al. |
| 6,729,709 | B2 | 5/2004 | Konno et al. |
| 6,733,100 | B1 | 5/2004 | Fujita et al. |
| 6,808,247 | B2 | 10/2004 | Kawatoko et al. |
| 6,846,066 | B2 | 1/2005 | Teshikawara et al. |
| 6,957,880 | B2 | 10/2005 | Kawatoko et al. |
| 6,960,036 | B1 | 11/2005 | Fujita et al. |
| 6,997,541 | B2 | 2/2006 | Edamura et al. |
| 7,057,756 | B2 | 6/2006 | Ogasahara et al. |
| 7,185,962 | B2 | 3/2007 | Takahashi et al. |
| 7,325,900 | B2 | 2/2008 | Hayashi et al. |
| 7,344,219 | B2 | 3/2008 | Sakamoto et al. |

(Continued)

FOREIGN PATENT DOCUMENTS

| | | | |
|---|---|---|---|
| JP | 2004291323 A | * | 10/2004 |
| JP | 2005-224955 A | | 8/2005 |

*Primary Examiner* — Sharon Polk
(74) *Attorney, Agent, or Firm* — Venable LLP

(57) ABSTRACT

A print head capable of forming dots on a print medium based on print data and a print medium are caused to perform relative movement in a specified direction, and a speed of the relative movement is set according to the number of dots to be formed in an area of a specified size. Whether to set the speed of the relative movement to a first speed is determined according to the number of dots to be formed in an area of a first size on the print medium. Whether to set the speed of the relative movement to a second speed lower than the first speed is determined according to the number of dots to be formed in an area of a second size which is smaller than the area of the first size in the specified direction.

17 Claims, 15 Drawing Sheets

(56) References Cited

U.S. PATENT DOCUMENTS

| | | | |
|---|---|---|---|
| 7,410,239 | B2 | 8/2008 | Takahashi et al. |
| 7,537,298 | B2 | 5/2009 | Oshio et al. |
| 7,604,344 | B2 | 10/2009 | Seki et al. |
| 7,748,809 | B2 | 7/2010 | Takahashi et al. |
| 8,079,665 | B2 | 12/2011 | Takahashi et al. |
| 8,147,019 | B2 | 4/2012 | Fujita et al. |
| 8,240,802 | B2 | 8/2012 | Nakano et al. |
| 8,251,480 | B2 | 8/2012 | Moriyama et al. |
| 8,313,188 | B2 | 11/2012 | Muro et al. |
| 8,328,311 | B2 | 12/2012 | Nakano et al. |
| 8,366,230 | B2 | 2/2013 | Taira et al. |
| 8,371,673 | B2 | 2/2013 | Maru et al. |
| 8,444,246 | B2 | 5/2013 | Muro et al. |
| 8,622,501 | B2 | 1/2014 | Komamiya et al. |
| 8,622,538 | B2 | 1/2014 | Miyakoshi et al. |
| 8,651,616 | B2 | 2/2014 | Maru et al. |
| 8,675,250 | B2 | 3/2014 | Muro et al. |
| 8,757,754 | B2 | 6/2014 | Azuma et al. |
| 9,028,029 | B2 | 5/2015 | Azuma et al. |
| 9,039,112 | B2 | 5/2015 | Murayama et al. |
| 9,079,421 | B2 | 7/2015 | Kato et al. |
| 9,108,403 | B2 | 8/2015 | Kawatoko et al. |
| 9,114,631 | B2 | 8/2015 | Fujita et al. |
| 9,162,496 | B2 | 10/2015 | Muro |
| 9,393,790 | B2 | 7/2016 | Kano et al. |
| 9,457,586 | B2 | 10/2016 | Fujita et al. |
| 2007/0002096 | A1* | 1/2007 | Teshigawara ..... B41J 2/205 347/37 |
| 2009/0079777 | A1 | 3/2009 | Nagamura et al. |
| 2009/0128595 | A1* | 5/2009 | Komamiya ..... B41J 19/202 347/14 |
| 2011/0032296 | A1 | 2/2011 | Nakano et al. |
| 2011/0249062 | A1 | 10/2011 | Nakano et al. |
| 2011/0310152 | A1 | 12/2011 | Muro et al. |
| 2012/0062651 | A1 | 3/2012 | Takahashi et al. |
| 2018/0022112 | A1* | 1/2018 | Billow ..... B41J 19/14 347/47 |

* cited by examiner

| | PRINT MODE | | |
|---|---|---|---|
| | FAST MODE (M1) | STANDARD MODE (M2) | BEAUTIFUL MODE (M3) |
| QUANTIZATION RESOLUTION | 300dpi | 600dpi | 1200dpi |
| PRINT RESOLUTION IN CONVEYANCE DIRECTION | 600dpi | 1200dpi | 1200dpi |
| DEFAULT CONVEYANCE SPEED | 26ips | 13ips | 6ips |
| CUSTOM CONVEYANCE SPEED | 13ips | 6ips | – |
| | 6ips | – | – |

FIG.5

PRINTING APPARATUS, PRINTING METHOD, AND STORAGE MEDIUM

BACKGROUND OF THE INVENTION

Field of the Invention

The present invention relates to printing apparatuses, printing methods, and storage media for printing images by means of dots.

Description of the Related Art

Such printing apparatuses include inkjet printing apparatuses using a print head (inkjet print head) capable of ejecting ink. In such an inkjet printing apparatus, as the number of ink ejections per unit time increases, the power consumption of the print head increases, and the flow rate of ink in the print head also increases. The increase in the power consumption of the print head requires a power supply with a large capacity, and this may increase the size and price of the printing apparatus. The increase in the flow rate of ink in the print head may increase the negative pressure in the print head, leading to ink ejection failure. Such limitation of the power consumption and ink flow rate of the print head limits the number of ink ejections per unit time in the print head.

Japanese Patent Laid-Open No. 2005-224955 describes a method of controlling the print speed (the scanning speed of the print head) in what is called a serial inkjet printing apparatus in order to limit the number of ink ejections per unit time in a print head. Specifically, the print data corresponding to one scanning area of a print head is divided into multiple blocks of a fixed size; the number of dots to be formed in each block is counted; and if the count value (dot count value) exceeds a specified value, the print speed is set low.

SUMMARY OF THE INVENTION

In Japanese Patent Laid-Open No. 2005-224955, for example, in the case where the print speed is different for each print mode, the relationship between the dot count value for each block of the fixed size and the number of ink ejections (the number of dots to be formed) per unit time varies depending on the print speed. Thus, it is difficult to accurately determine the number of ink ejections per unit time for different print speeds.

The present invention provides a printing apparatus, printing method, and storage medium in which reliable control can be performed according to the limitation of the power consumption of the print head and other factors by accurately determining the number of dots to be formed per unit time.

In the first aspect of the present invention, there is provided a printing apparatus comprising:

a print head capable of forming dots on a print medium based on print data;

a movement unit configured to cause relative movement of the print head and the print medium in a specified direction; and a setting unit configured to, based on the print data, set a speed of the relative movement caused by the movement unit to a first speed in a case where the number of dots to be formed in an area of a specified size on the print medium is smaller than or equal to a threshold, and set the speed of the relative movement to a speed lower than the first speed in a case where the number of dots to be formed in the area of the specified size is not smaller than the threshold, wherein the setting unit determines whether to set the speed of the relative movement to the first speed, according to the number of dots to be formed in an area of a first size on the print medium, and determines whether to set the speed of the relative movement to a second speed lower than the first speed, according to the number of dots to be formed in an area of a second size which is smaller than the area of the first size in the specified direction.

In the second aspect of the present invention, there is provided a printing method comprising the steps of:

causing relative movement of a print head and a print medium in a specified direction, the print head being capable of forming dots on the print medium based on print data; and setting, based on the print data, a speed of the relative movement to a first speed in a case where the number of dots to be formed in an area of a specified size on the print medium is smaller than or equal to a threshold, and the speed of the relative movement to a speed lower than the first speed in a case where the number of dots to be formed in the area of the specified size is not smaller than the threshold, wherein in the setting, it is determined whether to set the speed of the relative movement to the first speed, according to the number of dots to be formed in an area of a first size on the print medium, and it is determined whether to set the speed of the relative movement to a second speed lower than the first speed, according to the number of dots to be formed in an area of a second size which is smaller than the area of the first size in the specified direction.

In the third aspect of the present invention, there is provided a storage medium having stored therein a program for causing a computer to execute a printing method of printing an image on a print medium using a print head capable of forming dots on the print medium based on print data, the printing method comprising the steps of:

causing relative movement of the print head and the print medium in a specified direction; and setting, based on the print data, a speed of the relative movement to a first speed in a case where the number of dots to be formed in an area of a specified size on the print medium is smaller than or equal to a threshold, and the speed of the relative movement to a speed lower than the first speed in a case where the number of dots to be formed in the area of the specified size is not smaller than the threshold, wherein in the setting, it is determined whether to set the speed of the relative movement to the first speed, according to the number of dots to be formed in an area of a first size on the print medium, and it is determined whether to set the speed of the relative movement to a second speed lower than the first speed, according to the number of dots to be formed in an area of a second size which is smaller than the area of the first size in the specified direction.

The present invention achieves the reliable control according to the limitation of the power consumption of the print head and other factors by accurately determining the number of dots to be formed per unit time.

Further features of the present invention will become apparent from the following description of exemplary embodiments with reference to the attached drawings.

BRIEF DESCRIPTION OF THE DRAWINGS

FIG. 5 is an explanatory diagram for the print mode in the printing apparatus;

DESCRIPTION OF THE EMBODIMENTS

Hereinafter, embodiments of the present invention will be described based on the drawings.

(Overall Configuration of Printing Apparatus)

Figure 1:
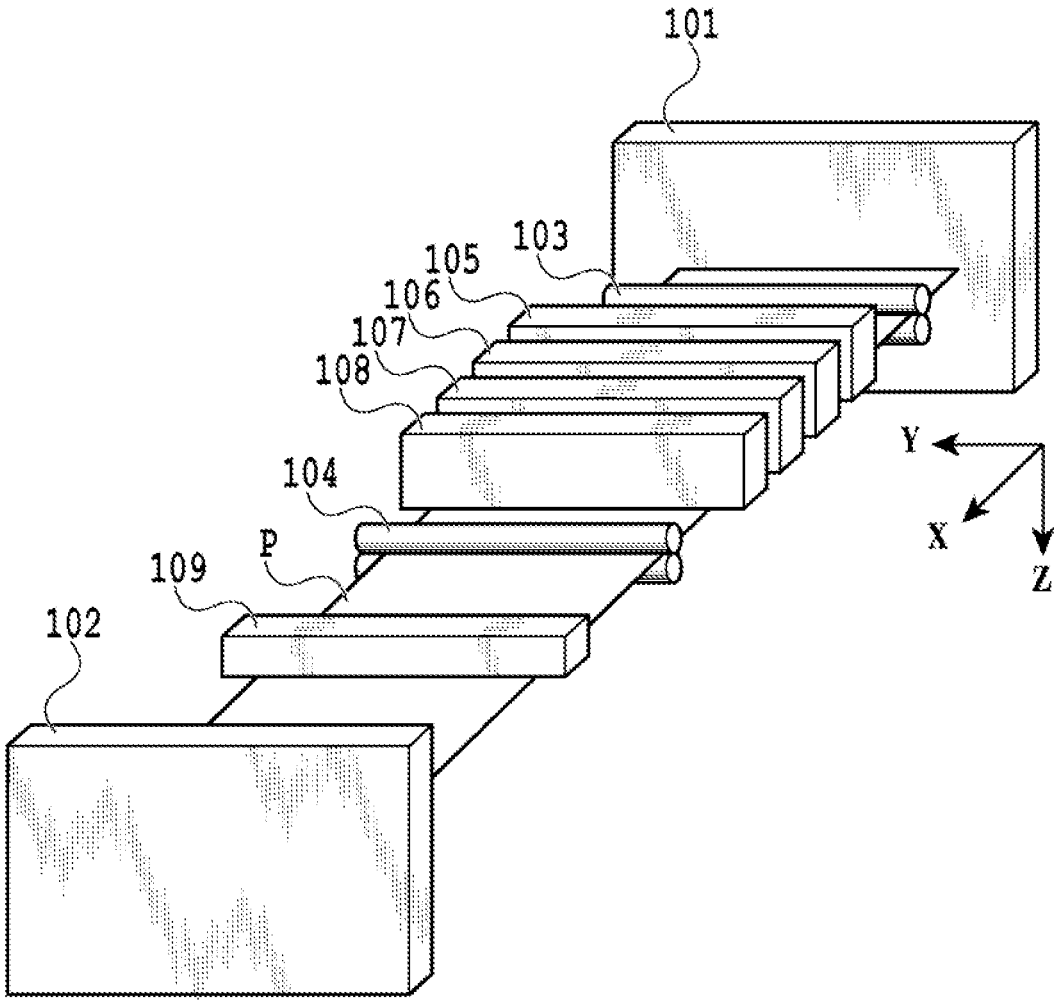
FIG. 1 is a schematic perspective view of a printing apparatus of the present invention.

FIG. 1 is a schematic configuration diagram of an inkjet printing apparatus (hereinafter, referred to as a "printing apparatus") according to the present embodiment. The printing apparatus of this example is what is called a full-line printing apparatus. A print medium P fed by a feeding unit 101 is continuously conveyed in the +X direction (conveyance direction) being nipped by conveying roller pairs 103 and 104 and discharged to a discharging unit 102. Between the conveying roller pair 103 and the conveying roller pair 104 are disposed print heads 105 to 108 that extend in a direction intersecting the conveyance direction (in this example, in the Y direction intersecting the conveyance direction). These print heads 105, 106, 107, and 108 are inkjet print heads capable of ejecting cyan, magenta, yellow, and black inks, respectively, in the +Z direction based on print data. In full-line printing apparatuses, in order to cause relative movement of the print heads and the print medium in a specified direction, the print medium is continuously conveyed in the +X direction relative to the print heads at fixed positions.

The print medium P may be a continuous sheet (such as continuous paper) in a role shape held by the feeding unit 101 or a cut sheet (such as cut paper) cut in advance into a standard size. For a continuous sheet, after a print operation by the print heads 105 to 108 finishes, the print medium P is cut into a specified length by a cutter 109, and the cut sheets are sorted out and placed onto output trays of the discharging unit 102 based on the sizes of the cut sheets.

(Print Head)

Figure 2:
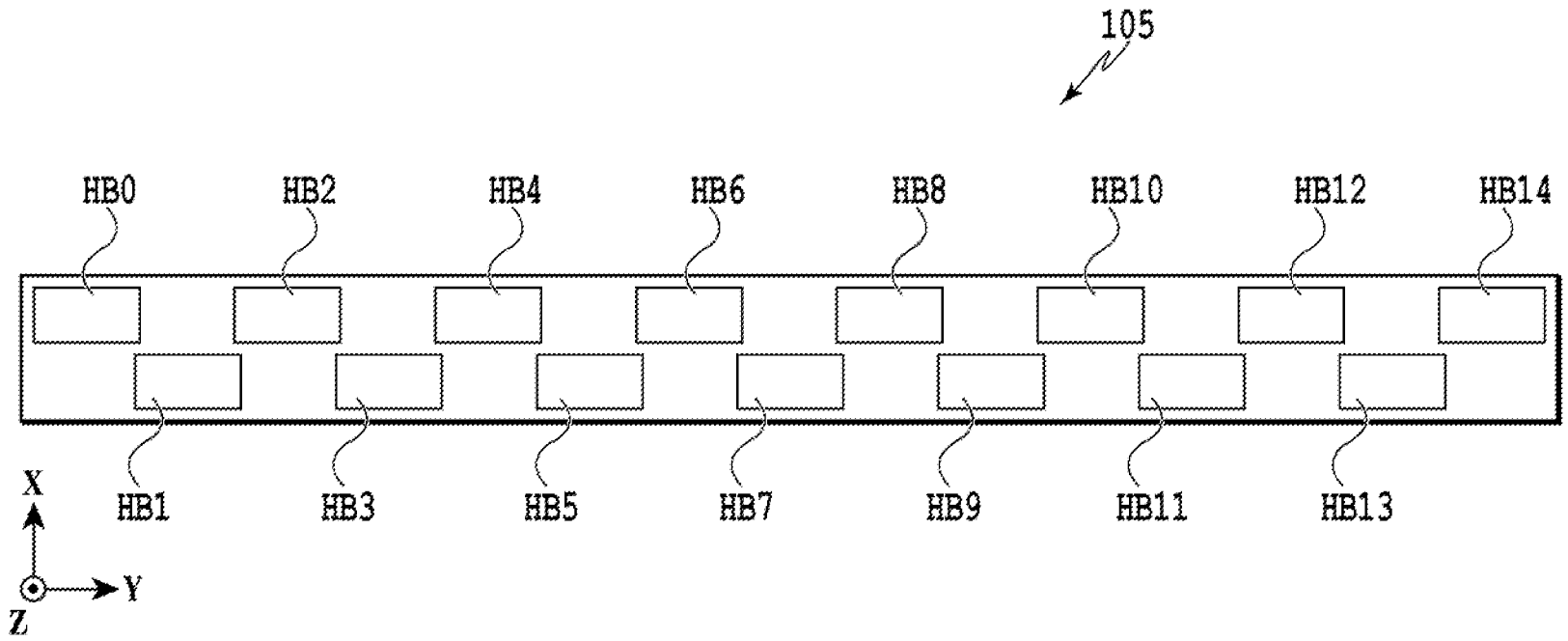
FIG. 2 is an enlarged view of a print head in FIG. 1.

FIG. 2 is an explanatory diagram for the configuration of the cyan-ink print head 105. The other print heads 106,107, and 108 have the same configuration as the print head 105.

The print head 105 in this example is equipped with 15 heater boards (printing element substrates) HB0 to HB14. Those heater boards are arrayed in the Y direction such that the end portions of each heater board in the Y direction are overlapped with those of another one. Use of the print head having the 15 heater boards HB0 to HB14 arrayed in the Y direction as described above enables an image to be printed to the entire area of a print medium in the width direction in the same way as in the case of using one long print head. The print medium is conveyed in the length direction orthogonal to its width direction.

Figure 3A:
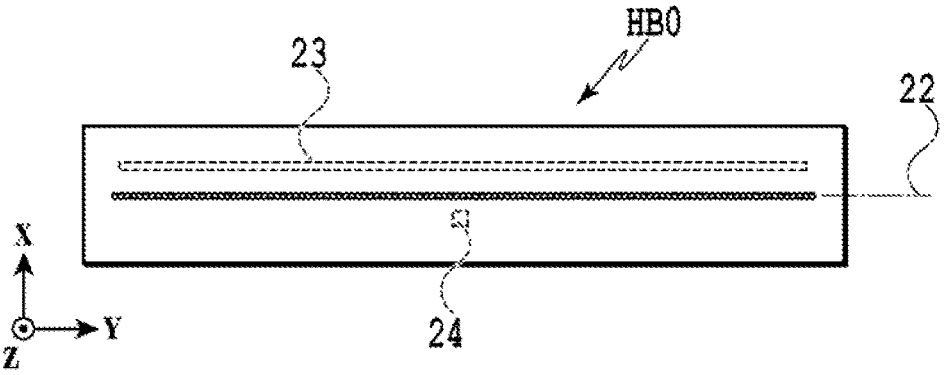
FIG. 3A is an explanatory diagram for the configuration a heater board in FIG. 2.
Figure 3B:
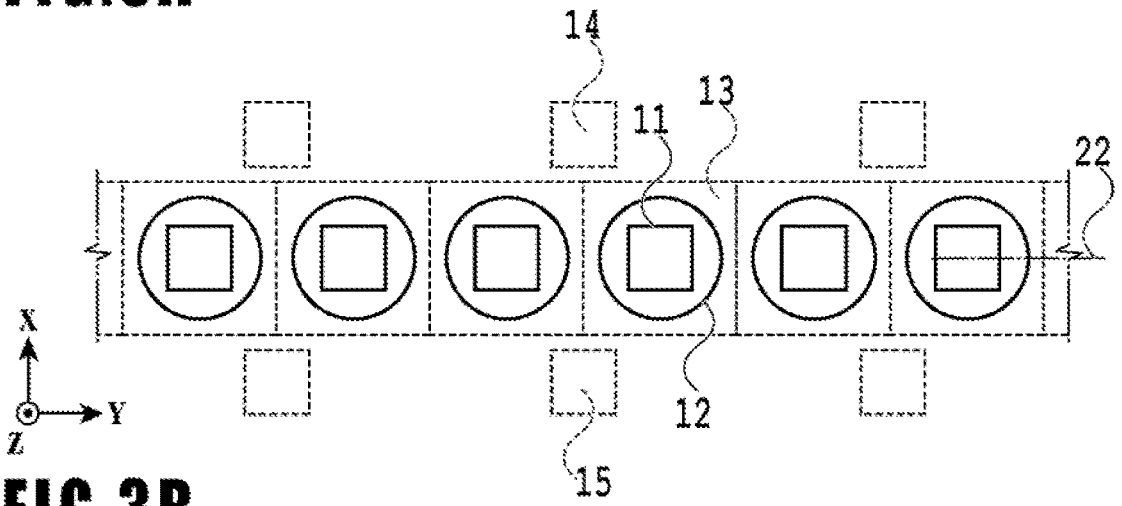
FIG. 3B is an enlarged view of part of the heater board.

FIG. 3A is an explanatory diagram for the configuration of the heater board HB0; FIG. 3B is an enlarged view of part of the heater board HB. The other heater boards HB1 to HB14 have the same configuration as the heater board HB0.

The heater board HB0 has an ejecting port array 22, a sub-heater (heating element) 23, and a temperature sensor (detection element) 24. The ejecting port array 22 has multiple ejecting ports 12 for ejecting cyan ink, arrayed in the Y direction. The heater board HB0 has pressure chambers 13 partitioned by partition walls and corresponding to the respective ejecting ports 12 forming the ejecting port array 22. Each pressure chamber 13 is provided with an ejection-energy generating element that generates energy for ejecting ink from the ejecting port 12, at a position facing the ejecting port 12. For the ejection-energy generating elements, heaters (electro-thermal conversion elements) or piezo elements can be used. In this example, heaters 11 are used as the ejection-energy generating elements. When drive pulses are applied to the heater 11, the heater 11 generates heat. The heat energy generates a bubble in ink, and the energy of the bubble generation is used to eject ink from the ejecting port. Hereinafter, the array of the heaters (ejection-energy generating elements) 11 corresponding to the ejecting port array 22 is also referred to as a printing element array.

The sub-heater 23 heats the ink around the heaters 11 to a degree at which the ink is not ejected from the ejecting ports 12. The temperature sensor 24 detects the temperature around the heaters 11 in the heater board HB0. In this example, the sub-heater 23 is driven during and before print operation according to the temperature detected by the temperature sensor 24 to perform control such that the temperature of ink is at a desired temperature. In this example, the heater board HB0 has one sub-heater 23 and one temperature sensor 24. Nevertheless, in the heater board HB0, one or both of the number of sub-heaters 23 and the number of temperature sensors 24 may be two or more. On the +X side of the ejecting port array 22 are disposed ink supply ports 14; on the −X side are disposed ink collecting ports 15. In this example, one ink supply port 14 and one ink collecting port 15 correspond to two ejecting ports 12.

Figure 3C:
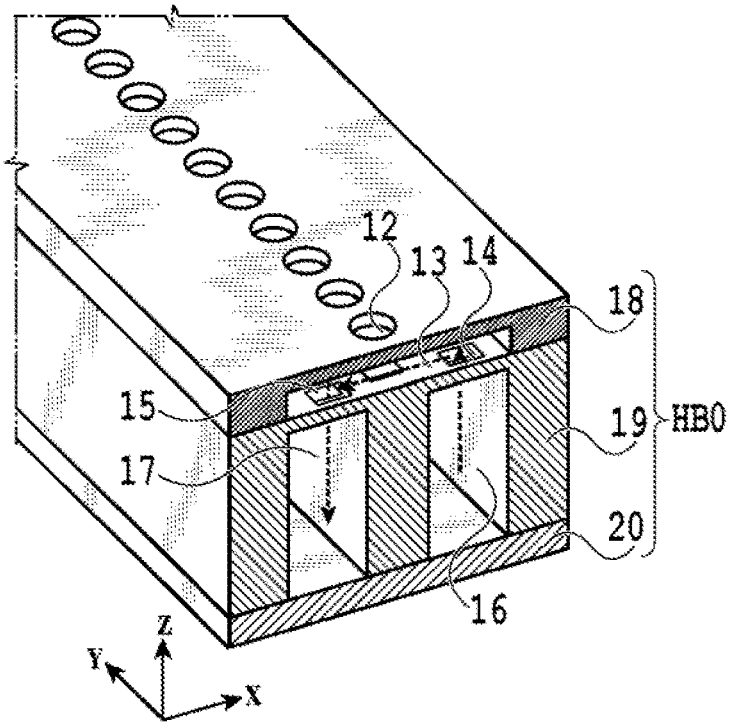
FIG. 3C is a cross-sectional view of the heater board.

FIG. 3C is a cross-sectional view of the heater board HB0. The heater board HB0 in this example has a three-layer structure. An ejecting-port forming member 18 formed of photosensitive resin is stacked on one side of a substrate 19 formed of Si, and a support member 20 is bonded to the other side of the substrate 19.

The ejecting-port forming member 18 has the ejecting ports 12, and the pressure chambers 13 are formed between the ejecting-port forming member 18 and the substrate 19. The heaters 11 are at positions on the ejecting-port forming member 18 side of the substrate 19. The substrate 19 has inside a common supply path 16 and a common collecting path 17 for ink. The substrate 19 further has the ink supply ports 14 each connecting the common supply path 16 and one side of the corresponding pressure chamber 13, and the ink collecting ports 15 each connecting the common collecting path 17 and the other side of the corresponding pressure chamber 13.

The common supply path 16 and the common collecting path 17 extend in the Y direction across the entire area where the ejecting ports 12 are arrayed. Control is performed such that a negative pressure difference occurs between the insides of the common supply path 16 and the common collecting path 17. This causes ink flows in the arrow direction in FIG. 3C in the pressure chambers 13 corresponding to the ejecting ports 12 that are not ejecting ink during print operation in which ink is ejected selectively from the multiple ejecting ports 12 based on print data. In other words, due to the pressure difference between the common supply path 16 and the common collecting path 17, the ink inside the common supply path 16 flows via the supply ports 14, pressure chambers 13, and collecting ports 15 toward the common collecting path 17. Unusual objects such as thickened ink and bubbles resulting from the evaporation of volatile components in ink from the ejecting port 12 can be collected using the ink flow described above through the common collecting path 17. The support member 20 has a function of a cover serving as part of walls forming the common supply path 16 and the common collecting path 17.

(Print Control System)

Figure 4:
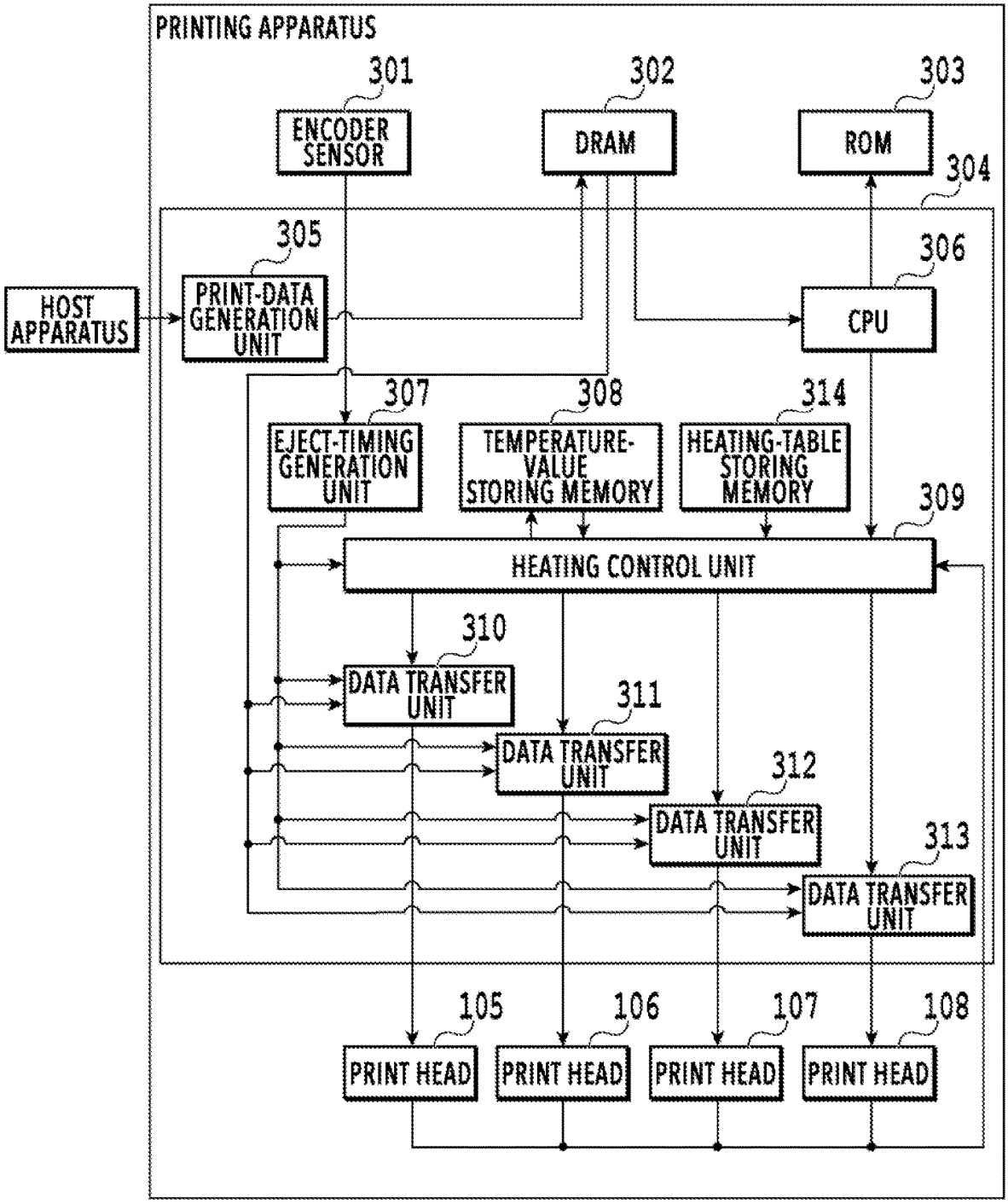
FIG. 4 is a block diagram of the control system of the printing apparatus.

FIG. 4 is a block diagram for explaining the configuration of the print control system in the printing apparatus. In the following, only a print control system for the print head 105 of the print heads 105 to 108 will be described as a representative example, for convenience of explanation.

The printing apparatus in this example includes an encoder sensor 301, a DRAM 302, a ROM 303, a controller (ASIC) 304, and the print heads 105 to 108. The controller 304 includes a print-data generation unit 305, a CPU 306, an eject-timing generation unit 307, a temperature-value storing memory 308, a heating-table storing memory 314, and data transfer units 310 to 313. The CPU 306 reads programs stored in the ROM 303 and executes them to control the entire operation of the printing apparatus including, for example, driving various motors included in the printing apparatus via driver circuits. The ROM 303 stores fixed data necessary for various operations of the printing apparatus, in addition to various control programs to be executed by the CPU 306. For example, the ROM 303 stores programs used for executing print control in the printing apparatus.

The DRAM 302 is used as a work area for the CPU 306 to execute programs, a temporally storage area for various reception data, a memorization area for various setting data, and other purposes. The number of DRAMs 302 included is not limited to one but may be two or more, and an SRAM may be mounted in addition to the DRAM to make available multiple memories having different access speeds. The print-data generation unit 305 receives image data from a host apparatus (such as PC) outside the printing apparatus. The print-data generation unit 305 performs color conversion processing, quantization processing, and other processing on the image data to generate binary print data for ejecting in from each of the print heads 105 to 108 and stores the print data in the DRAM 302. The encoder sensor 301 detects positional information on the relative position between the print heads 105 to 108 and the print medium P, and the eject-timing generation unit 307 receives the positional information. The encoder sensor 301 is, for example, a sensor that detects the amount of rotation of the conveying roller pair 103 or 104, and the amount of rotation indicates the conveyance position (movement position) of the print medium P relative to the print heads 105 to 108. The eject-timing generation unit 307 generates eject-timing information for setting ink ejection timings of the print heads 105 to 108 based on the positional information.

The temperature-value storing memory 308 stores temperature information detected by the temperature sensors 24 in the heater boards HB0 to HB14 of the print heads 105 to 108. The four data transfer units 310 to 313 read the print data from the DRAM 302 according to the ejection timing generated by the eject-timing generation unit 307. A heating control unit 309 generates heating information for setting conditions of the sub-heaters 23 for heating the heater boards HB0 to HB14 based on the temperature information stored in the temperature-value storing memory 308 and a table stored the heating-table storing memory 314. The data transfer units 310 to 313 transfer the print data and the heating information to the print heads 105 to 108.

The print heads 105 to 108 eject ink by the heaters 11 being driven based on the print data while the sub-heaters 23 are performing heating operation based on the heating information. At that time, the temperatures detected by the temperature sensors 24 in the heater boards HB0 to HB14 in the print heads 105 to 108 are inputted to the heating control unit 309 in the printing apparatus. The heating control unit 309 stores temperature information on newly detected temperatures in the temperature-value storing memory 308 to update the temperature information. This updated temperature information is used at the next timing for generating the heating information.

(Print Mode)

FIG. 5 is an explanatory diagram for print modes of the printing apparatus. The print modes in this example include three modes: "fast mode (high-speed print mode)" M1, "standard mode" M2, and "beautiful mode (high-definition mode)" M3. For each print mode, the quantization resolution of image data, the conveyance speed (moving speed) of the print medium, and the print resolution of the print medium in the conveyance direction can be set as illustrated in FIG. 5. For each print mode, the number of dots formed per unit area on the print medium can be set different.

In a case where the print duty (corresponding to the amount of ink applied to a unit print area) is low, in other words, in a case where the number of dots to be formed in a unit area is small, a default conveyance speed ips (inch/sec) corresponding to each print mode is set. In a case of high duty printing (in a case where the number of dots to be formed is large), the conveyance speed is set lower for printing, and the conveyance speed set in this case is called a custom conveyance speed. For example, in the "fast mode" M1, the conveyance speed of the print medium for the low duty printing is set to 26 ips, and as the print duty increases, the conveyance speed is decreased, for example, to 13 ips, and then, to 6 ips. In this example, the conveyance speed of the print medium can be changed to the three levels: 26 ips, 13 ips, and 6 ips, and the lowest conveyance speed is 6 ips. How to determine the conveyance speed will be described later. For the "fast mode" M1 in which the default conveyance speed is 26 ips, the custom conveyance speeds that can be set are 13 ips and 6 ips, and for the "standard mode" M2 in which the default conveyance speed is 13 ips, the custom conveyance speed that can be set is 6 ips. For the "beautiful mode" M3 in which the default conveyance speed is 6 ips, the custom conveyance speed cannot be set.

(Method of Determining Conveyance Speed)

In this example, the number of ink dots to be formed in each dot count window (area) W is counted (dot-counting) based on the image data for each dot count window W having a specified size, and the conveyance speed is determined based on the count values.

Figure 6A:
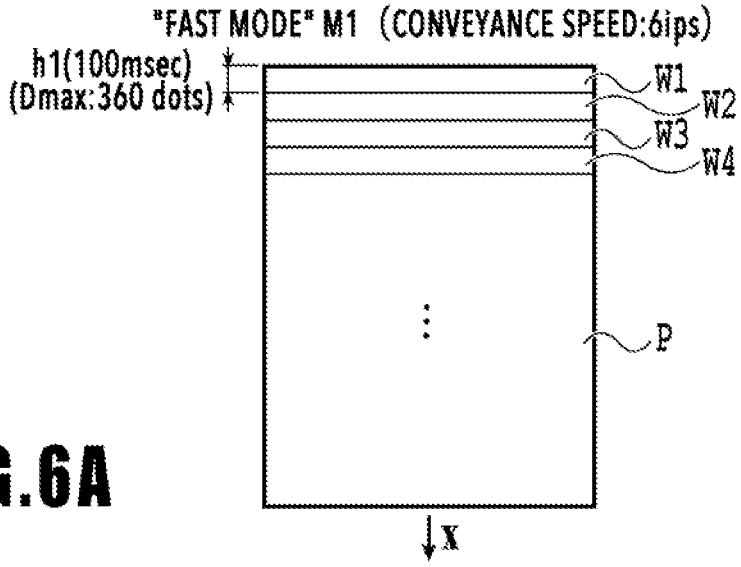
FIGS. 6A, 6B, and 6C are explanatory diagrams for the relationship between windows and a print medium for different conveyance speeds in the "fast mode"
Figure 6B:
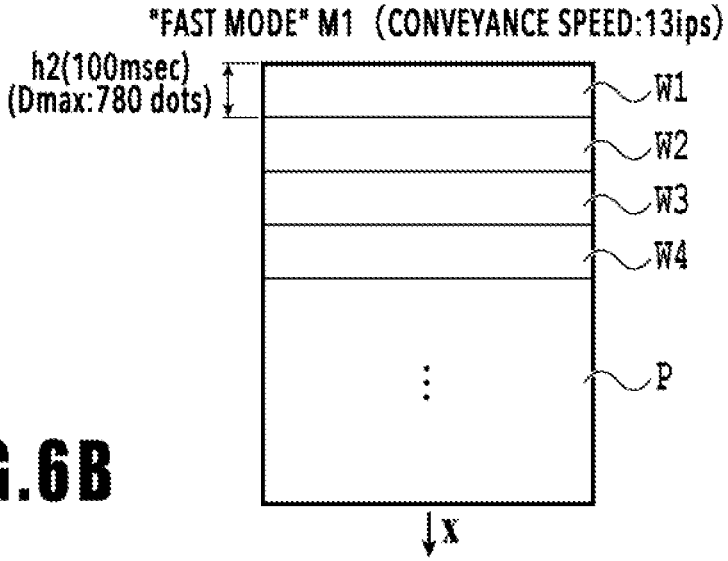
Figure 6C:
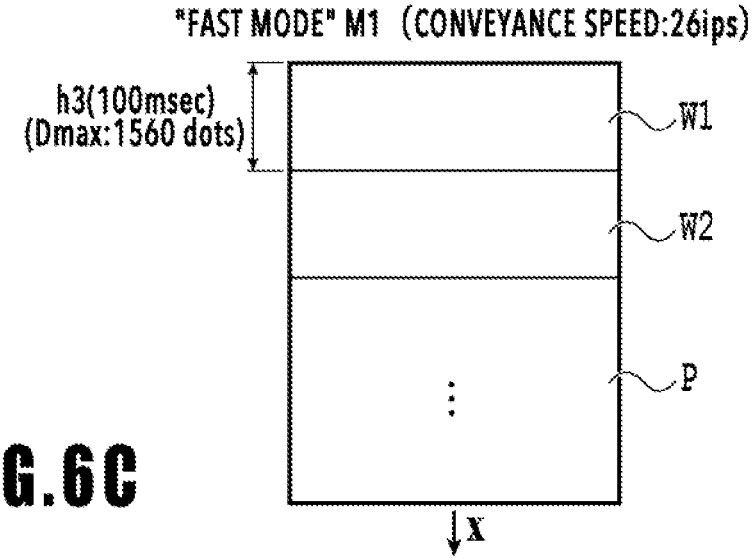
Figure 7A:
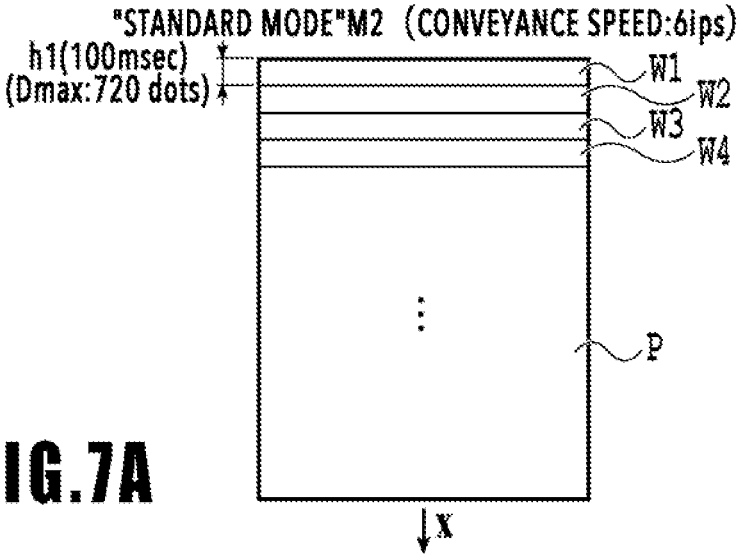
FIGS. 7A and 7B are explanatory diagrams for the relationship between windows and a print medium for different conveyance speeds in the "standard mode"
Figure 7B:
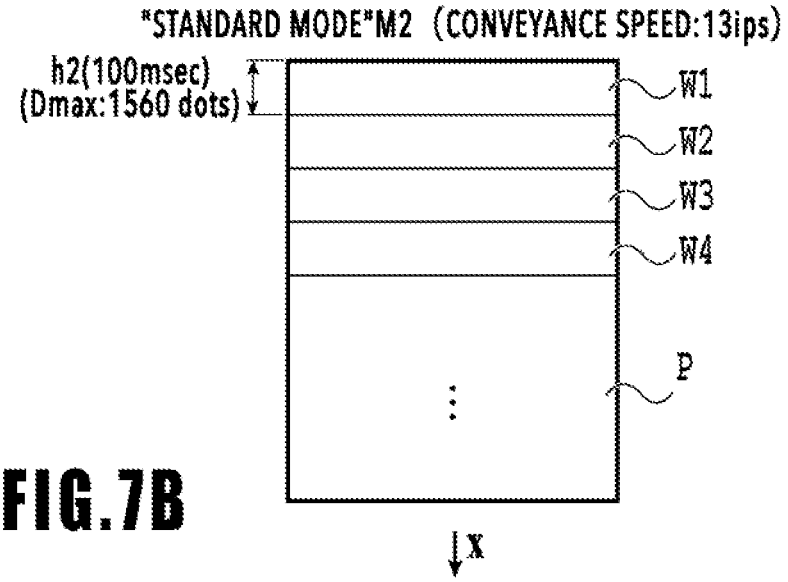

FIGS. 6A, 6B, and 6C are schematic diagrams in which the dot count window (window) W is associated with the print medium Pin the "fast mode" M1. FIGS. 6A, 6B, and 6C each illustrate the size of the window Win a case where the conveyance speed is 6 ips, 13 ips, and 26 ips. FIGS. 7A and 7B are schematic diagrams in which the dot count window (window) W is associated with the print medium P in the "standard mode" M2. FIGS. 7A and 7B each illustrate the window size in a case where the conveyance speed is 6 ips or 13 ips.

The windows W (W1, W2, . . . ) in mode M1 in FIG. 6A and the windows W (W1, W2, . . . ) in mode M2 in FIG. 7A have the same width h1 in the conveyance direction of the print medium and thus have the same size (window size). The windows W (W1, W2, . . . ) in mode M1 in FIG. 6B and the windows W (W1, W2, . . . ) in mode M2 in FIG. 7B have the same width h1 in the conveyance direction of the print medium and thus have the same size (window size). As just described, in the case where the window sizes are the same in different print modes, the maximum numbers of dots that can be formed in the windows W of the same size are different.

Specifically, in a case of limiting the number of ink ejections per 100 msec due to the limitation of the power consumption and the ink flow rate of the print head and other factors, the width h1 of the window W is 0.6 inch for both FIG. 6A and FIG. 7A in which the conveyance speed is 6 ips. However, for the window W in FIG. 6A, the maximum number of dots Dmax that can be formed in the window W in the width h1 direction is 360 dots (600 dpi×0.6 i). For the window W in FIG. 7A, the maximum number of dots Dmax that can be formed in the window W in the width h1 direction is 720 dots (1200 dpi×0.6 i). In the same manner, in a case of limiting the number of ink ejections per 100 msec, the width h2 of the window W is 1.3 inch for both FIG. 6B and FIG. 7B in which the conveyance speed is 13 ips. However, for the window W in FIG. 6B, the maximum number of dots Dmax that can be formed in the window Win the width h2 direction is 780 dots (600 dpi×1.3 i). For the window Win FIG. 7B, the maximum number of dots Dmax that can be formed in the window W in width h2 direction is 1560 dots (1200 dpi×1.3 i). The width h3 of the window W in FIG. 6C in which the conveyance speed is 26 ips is 2.6 inch, and the maximum number of dots Dmax that can be formed in the window Win the width h3 direction is 1560 dots (600 dpi×2.6 i).

As will be described later, due to the limitation of the power consumption and the ink flow rate of the print head and other factors, the conveyance speed is set so that the number of ink ejections of a print head per unit time (in this example, per 100 msec) is limited to a specified threshold or smaller. The conveyance speed can be set for each specified print area of the print medium (in this example, for each page).

Figure 8:
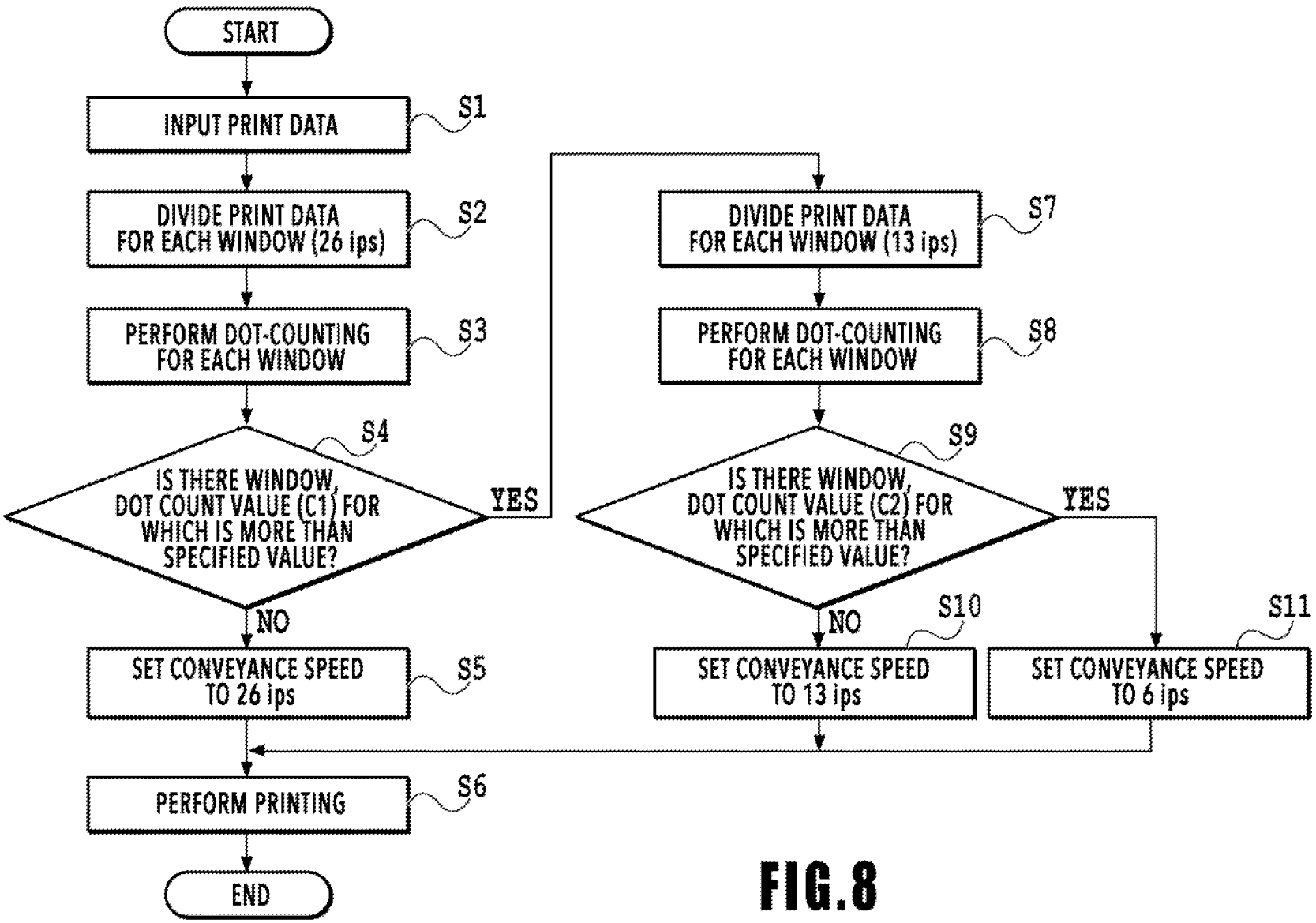
FIG. 8 is a flowchart for explaining a determination process of determining the conveyance speed in the "fast mode"

FIG. 8 is a flowchart for explaining a determination process for determining the conveyance speed of the print medium in the "fast mode" M1. A series of processes in FIG. 8 is performed by the CPU 306 loading program codes stored in the ROM 303 into the DRAM 302 and executing them. Alternatively, part or all of the functions of the steps in FIG. 8 may be implemented by hardware, such as an ASIC, an electronic circuit, or the like. The symbol "S" attached to the explanation of each process means "step".

Figure 9A:
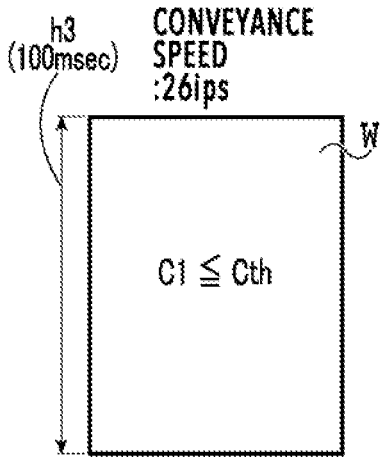
FIGS. 9A, 9B, and 9C are explanatory diagrams for the determination process of determining the conveyance speed for different dot count values in the "fast mode"

The CPU 306, first, inputs print data for one page generated by the print-data generation unit 305 (51) and divides the print data for each window W (W1, W2, . . . ) for the conveyance speed 26 ips illustrated in FIG. 6C (S2). After that, the CPU 306 counts, for each window W, the number of dots to be formed using the print data for the window W (dot-counting) (S3). The CPU 306 thus functions as a counting unit that counts dots. The CPU 306 determines whether there is a window W such a dot count value (count value) C1 for which is larger than a specified threshold (hereinafter, called "specified value") Cth (S4). In a case where there is no window W the dot count value C1 for which exceeds the specified value Cth in the print data for one page, the CPU 306 sets the conveyance speed to 26 ips (S5) and performs print operation (S6). Specifically, as illustrated in FIG. 9A, in a case where all the count values C1 of the dots to be formed in each of the multiple windows W for the conveyance speed 26 ips is the specified value Cth or less within one page (within a specified print range), the conveyance speed of the one page is set to 26 ips.

In a case where there is at least one window W the count value C1 for which exceeds the specified value Cth within the print data for one page, the CPU 306 divides the print data for the one page for each window W (W1, W2, . . . ) for the conveyance speed 13 ips illustrated in FIG. 6B (S7). After that, the CPU 306 counts, for each window W, the number of dots to be formed using the print data for the window W (S8), and the CPU 306 determines whether there is a window W such a count value C2 for which is more than the specified value Cth (S9). In a case where there is no window W the dot count value C2 for which exceeds the specified value Cth, in the print data for one page, the CPU 306 sets the conveyance speed to 13 ips (S10) and performs print operation (S6). On the other hand, in a case where there is at least one window W the count value C2 for which exceeds the specified value Cth in the print data for one page, the CPU 306 sets the conveyance speed to 6 ips (S11) and performs print operation (S6).

Figure 9B:
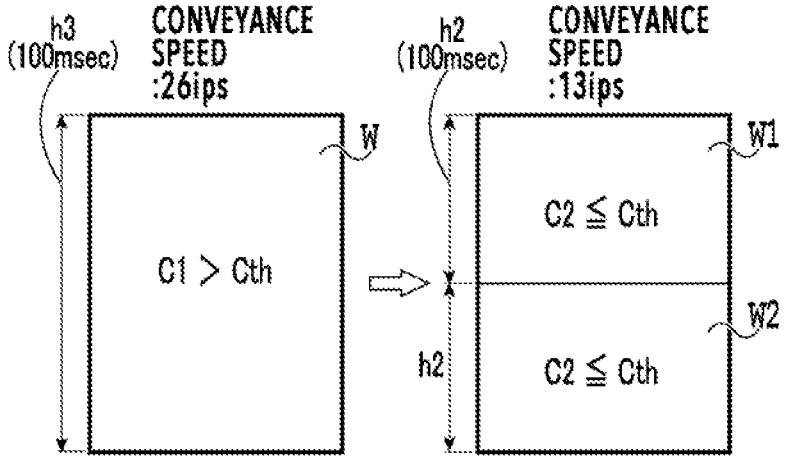
Figure 9C:
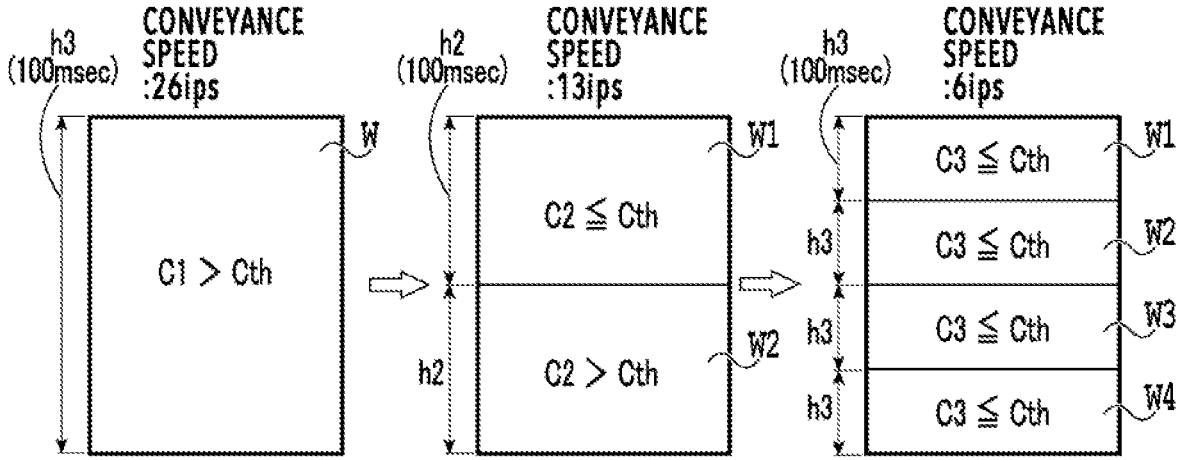

Specifically, in the case where at least one count value C1 of the dots to be formed in each of the multiple windows W for the conveyance speed 26 ips exceeds the specified value Cth, the print data is divided for each window W (W1, W2) for the conveyance speed 13 ips, as illustrated in FIGS. 9B and 9C. Then, as illustrated in FIG. 9B, in the case where all the count values C2 of the dots to be formed in each of the multiple windows W (W1, W2) for the conveyance speed 13 ips are the specified value Cth or less, the conveyance speed is set to 13 ips. On the other hand, as illustrated in FIG. 9C, in the case where at least one count value C2 of the dots to be formed in each of the multiple windows W (W1, W2) for the conveyance speed 13 ips exceeds the specified value Cth, the conveyance speed is set to 6 ips.

Figure 10:
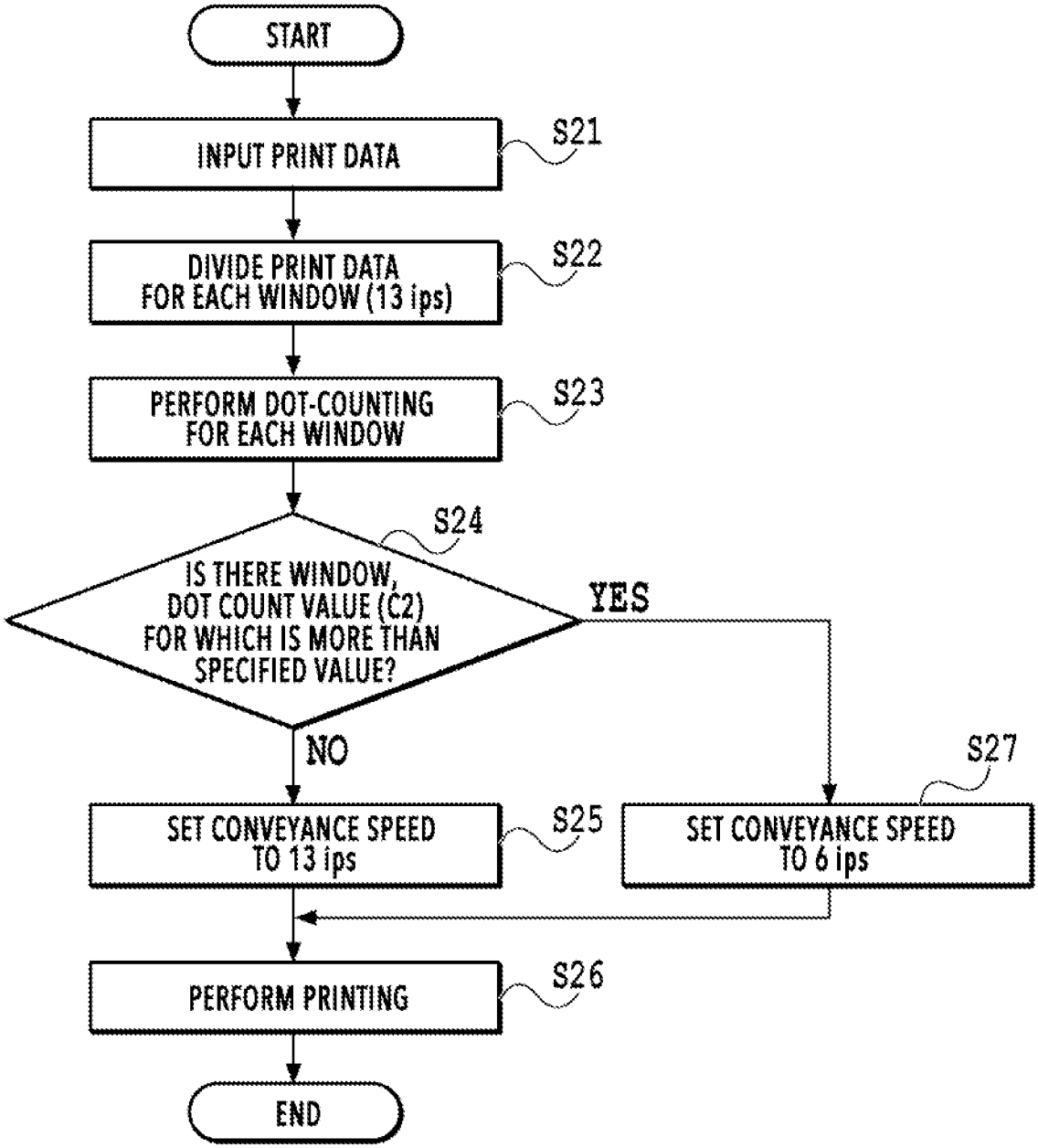
FIG. 10 is a flowchart for explaining a determination process of determining the conveyance speed in the "standard mode"

FIG. 10 is a flowchart for explaining a determination process for determining the conveyance speed of the print medium in the "standard mode" M2. A series of processes in FIG. 10 is performed by the CPU 306 loading program codes stored in the ROM 303 into the DRAM 302 and executing them. Alternatively, part or all of the functions of the steps in FIG. 10 may be implemented by hardware, such as an ASIC, an electronic circuit, or the like. The symbol "S" attached to the explanation of each process means "step".

The CPU 306, first, inputs print data for one page generated by the print-data generation unit 305 (S21) and divides the print data for each window W (W1, W2, . . . ) for the conveyance speed 13 ips illustrated in FIG. 6B (S22). After that, the CPU 306 counts, for each window W, the number of dots to be formed using the print data for the window W (S23) and determines whether there is a window W such a dot count value C2 for which is larger than the specified threshold Cth (S24). In a case where there is no window W the dot count value C2 for which exceeds the specified value Cth in the print data for one page, the CPU 306 sets the conveyance speed to 13 ips (S25) and performs print operation (S26). On the other hand, in a case where there is at least one window W the count value C2 for which exceeds the specified value Cth in the print data for one page, the CPU 306 sets the conveyance speed to 6 ips (S27) and performs print operation (S26).

Figure 11A:
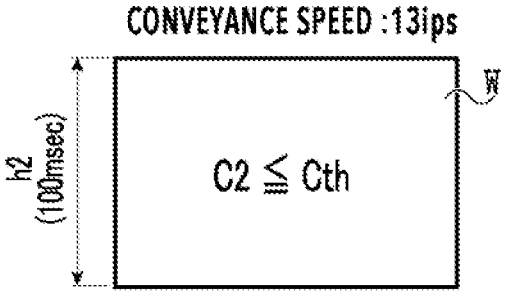
FIGS. 11A and 11B are explanatory diagrams for a determination process of determining the conveyance speed for different dot count values in the "standard mode"
Figure 11B:
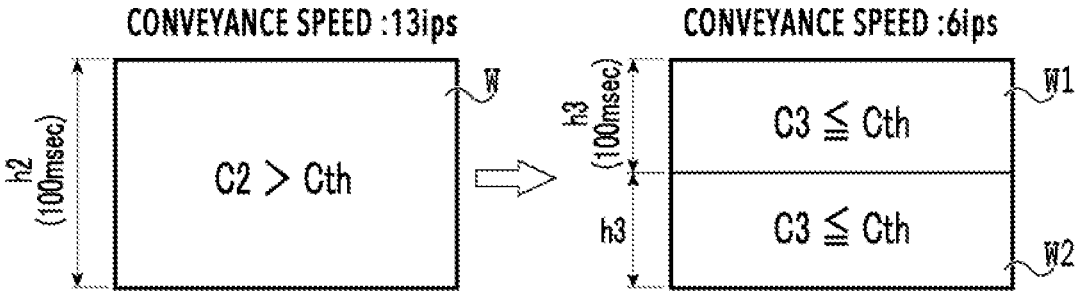

Specifically, as illustrated in FIG. 11A, in the case where all the count values C2 of the dots to be formed in each of the multiple windows W for the conveyance speed 13 ips is the specified value Cth or less, the conveyance speed is set to 13 ips. On the other hand, as illustrated in FIG. 11B, in the case where at least one count value C2 of the dots to be formed in each of the multiple windows W (W1, W2) for the conveyance speed 13 ips exceeds the specified value Cth, the conveyance speed is set to 6 ips.

In a case where the "beautiful mode" M3 is set for the print mode, the selectable conveyance speed is only 6 ips (default speed) which is the lowest. At the conveyance speed 6 ips, even when the print duty is highest, the count value C3 for each window W does not exceed the specified value Cth, the print head can eject ink properly within the range of the limitation of the power consumption and the ink flow rate of the print head and other factors. Thus, the CPU 306 does not perform a process to determine the conveyance speed in the "beautiful mode" M3.

Figure 12A:
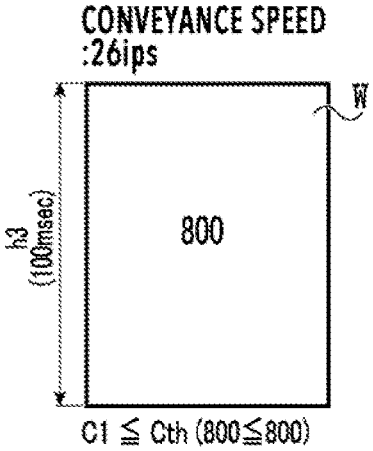
FIGS. 12A, 12B, and 12C are explanatory diagrams for specific examples of a method of setting the conveyance speed for different dot count values.
Figure 12B:
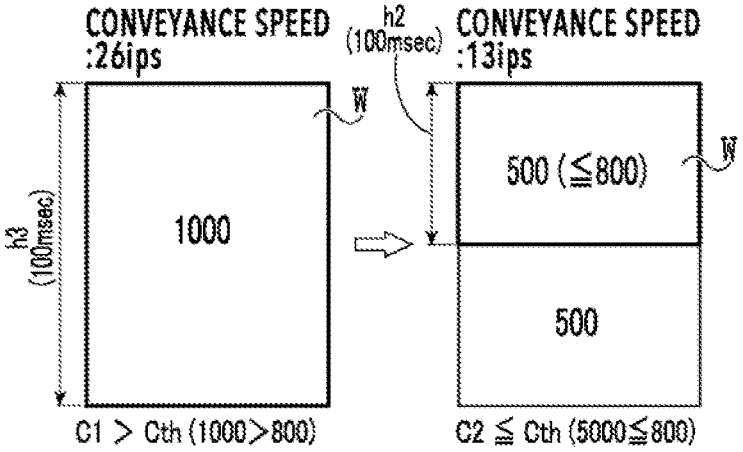
Figure 12C:
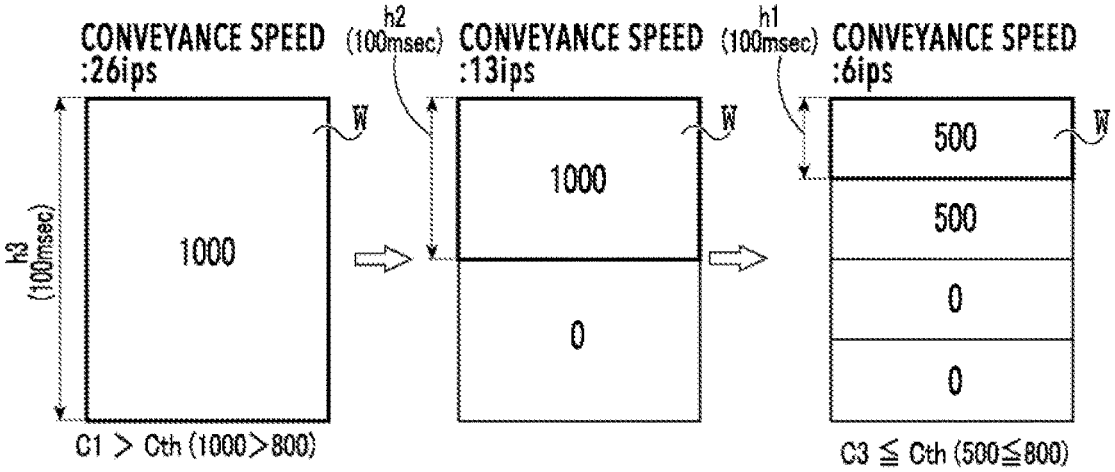

FIGS. 12A, 12B, and 12C are explanatory diagrams for specific examples for the case where, for example, the number of ink ejections per 100 msec is limited to 800 or less using the specified value Cth due to the limitation of the power consumption and the ink flow rate of the print head and other factors.

As illustrated in FIG. 12A, the number of dots to be formed in each of the multiple windows W for the conveyance speed 26 ips, in other words, each count value C1 is 800 or less which is the specified value Cth, the conveyance speed is set to 26 ips. In a case illustrated in FIG. 12B, at least one count value C1 for each of the multiple windows W for the conveyance speed 26 ips is 1000 which exceeds the specified value Cth (800). In this case, the count value C2 for each of the windows W for the conveyance speed 13 ips is compared to the specified value Cth. In FIG. 12B, all the count values C2 are the specified value Cth (800) or less, and thus the conveyance speed is set to 13 ips. On the other hand, in a case where at least one of the count values C2 exceeds the specified value Cth (800) as illustrated in FIG. 12C, the conveyance speed is set to 6 ips.

In the present embodiment as described above, the size of the window W (window size) is set different for each of the conveyance speeds 26 ips, 13 ips, and 6 ips, and an appropriate conveyance speed is determined based on the comparison result between the count value for each window (for each area) and a specified value. This configuration, as can be seen from the comparison with comparative examples described later, makes it possible to prevent ink ejection failure that would be otherwise caused by power shortage or excessive ink flow rate while preventing an unnecessary decrease in the throughput.

Comparative Example

FIGS. 14A, 14B, 15A, and 15B are explanatory diagrams for comparative examples in which windows W of the same size are used for the conveyance speed 26 ips, 13 ips, and 6 ips. In these comparative examples, it is assumed that the number of ink ejections per 100 msec is limited to 800 or less as in the specific examples in FIGS. 12A, 12B, and 12C described above. The priority when setting the conveyance speed is in the order of 26 ips, 13 ips, and 6 ips.

Figure 14A:
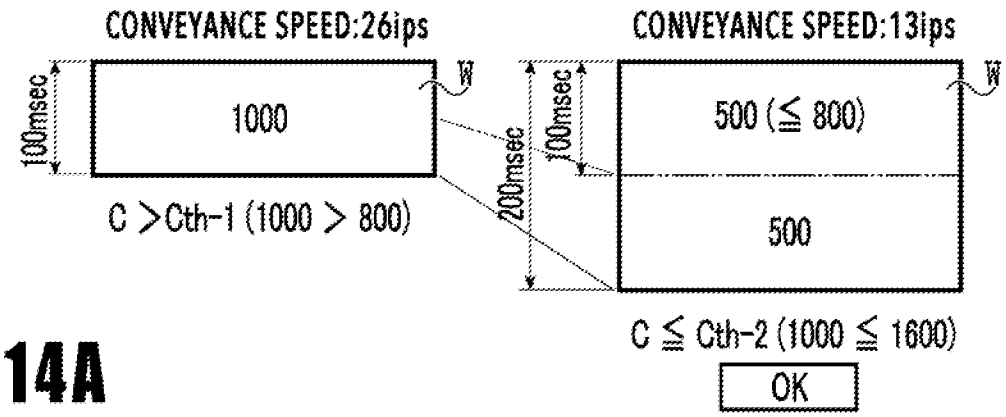
FIGS. 14A and 14B are explanatory diagrams for a comparative example of a method of setting the conveyance speed for different dot count values.
Figure 14B:
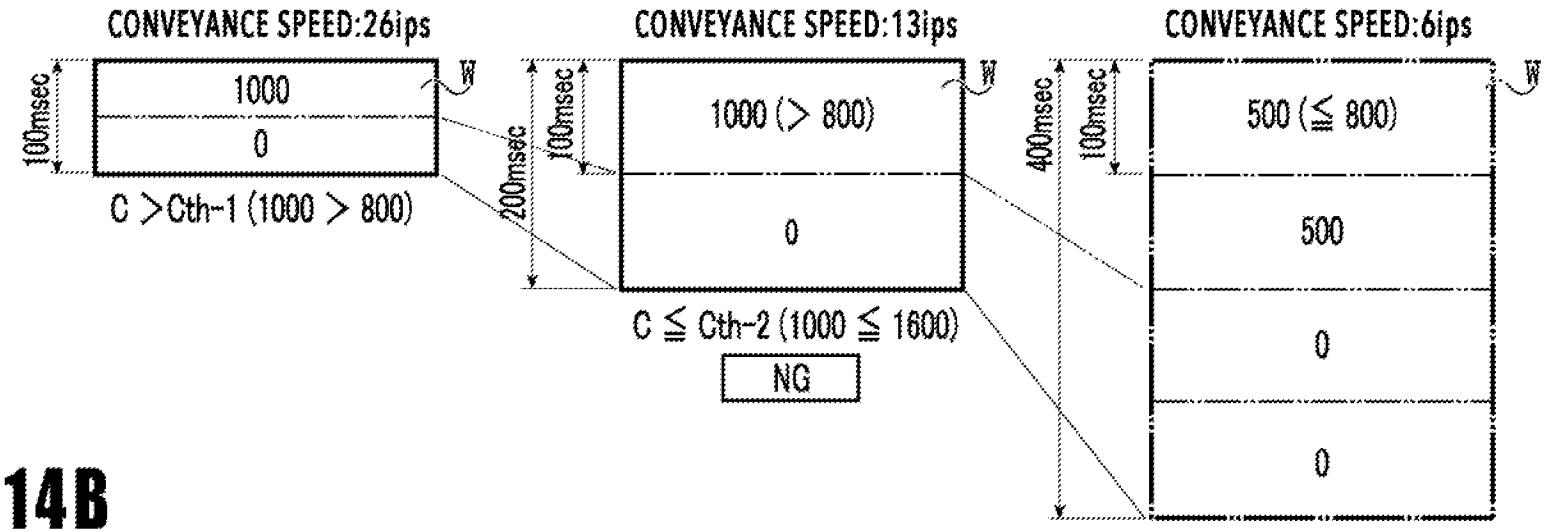

In comparative examples in FIGS. 14A and 14B, Cth-1, the specified value (threshold) which is the criterion to set the conveyance speed to 26 ips, was set to 800, and Cth-2, the specified value (threshold) which is the criterion to set the conveyance speed to 13 ips, was set to 1600. As illustrated in FIG. 14A, in a case where the count value C is 1000, which exceeds the specified value Cth-1 (800), the count value C is compared to the specified value Cth-2 (1600). Because the count value C is 1000, which is the specified value Cth-2 or less, the conveyance speed is set to 13 ips. In a case where the conveyance speed is set to 13 ips as illustrated in FIG. 14A, the count value C per 100 msec does not exceed the limit value 800, and thus it will not cause a problem.

However, in a case where the distribution of the dots to be formed is shifted to one window W side as illustrated in FIG. 14B, the count value C per 100 msec with the conveyance speed set to 13 ips exceeds the limit value 800. In this case, as the dashed double-dotted lines in FIG. 14B indicate, although the conveyance speed needs to be set to 6 ips, the conveyance speed is set to 13 ips, and thus, ink cannot be ejected properly. In other words, in the case where the distribution of the dots to be formed is shifted to one window W side, an appropriate conveyance speed cannot be set.

Figure 15A:
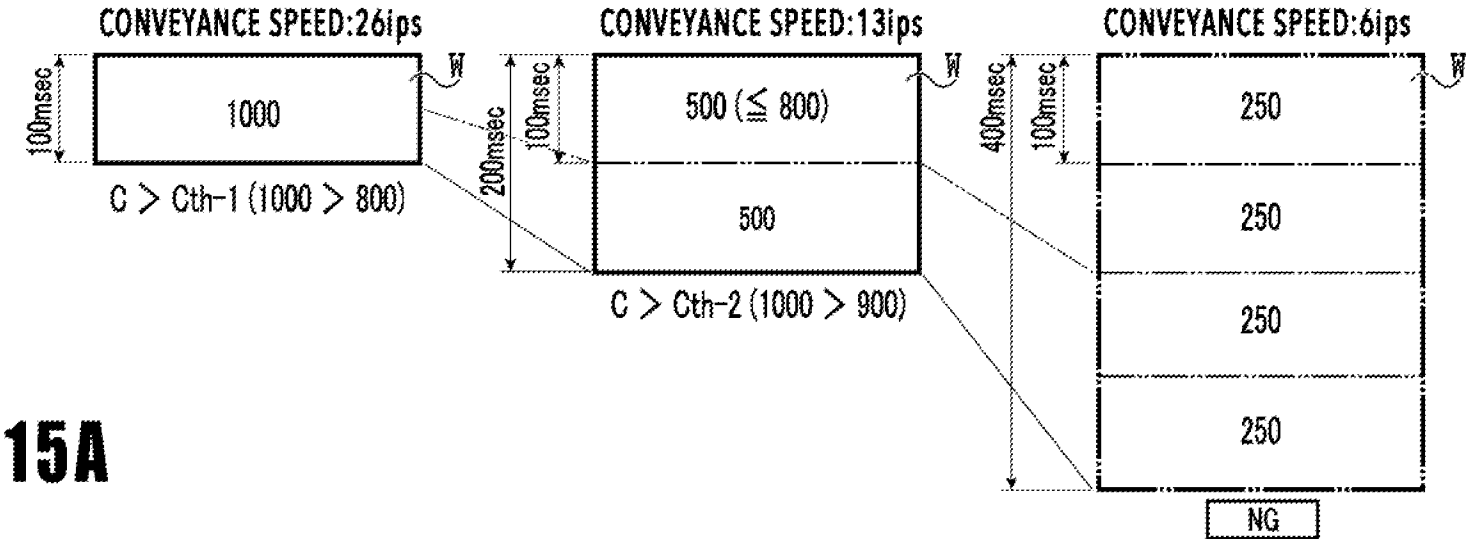
FIGS. 15A and 15B are explanatory diagrams for another comparative example of a method of setting the conveyance speed for different dot count values.
Figure 15B:
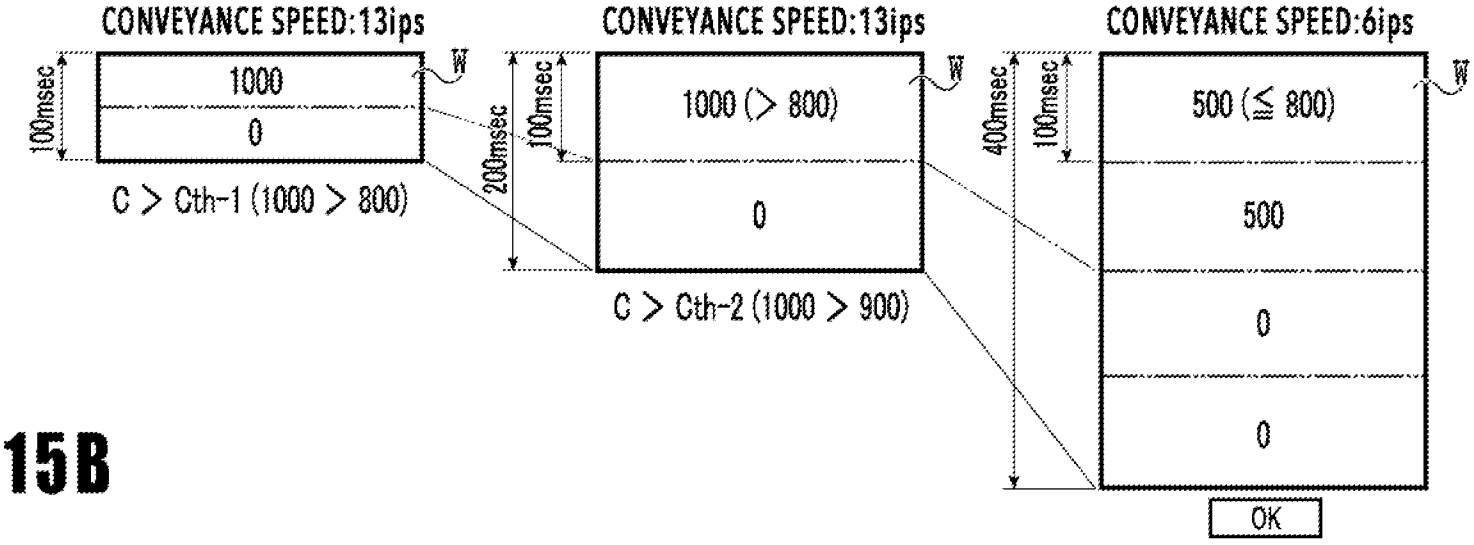

In comparative examples in FIGS. 15A and 15B, Cth-1, the specified value (threshold) which is the criterion to set the conveyance speed to 26 ips, was set to 800, and Cth-2, the specified value (threshold) which is the criterion to set the conveyance speed to 13 ips, was set to 900. As illustrated in FIG. 15A, in a case where the count value C is 1000, which exceeds the specified value Cth-1 (800), the count value C is compared to the specified value Cth-2 (900). Because the count value C exceeds the specified value Cth-2, the conveyance speed is set to 6 ips. However, as illustrated in FIG. 15A, in the case where dots are formed uniformly among the windows W, the count value C per 100 msec with the conveyance speed set to 13 ips does not exceed the limit value 800. In other words, although the conveyance speed can be set to 13 ips, it is set to a lower value, 6 ips, resulting in an unnecessary decrease in throughput. On the other hand, in a case where the distribution of the dots to be formed is shifted to one window W side as illustrated in FIG. 15B, the conveyance speed is set to 6 ips, and the count value C per 100 msec does not exceed the limit value 800. Thus, this setting will not cause a problem.

In the case where the windows W of the same size are used as the windows for different conveyance speeds as in these comparative examples, an appropriate conveyance speed cannot be set. In the case of FIG. 14B, ink cannot be ejected properly; in the case of FIG. 15A, a decrease in throughput occurs.

Other Embodiments

In the above embodiment, the same specified value Cth is used for the criteria to set the conveyance speeds 26 ips, 13 ips, and 6 ips. However, a different specified value may be set for each of the conveyance speeds 26 ips, 13 ips, and 6 ips.

Figure 13A:
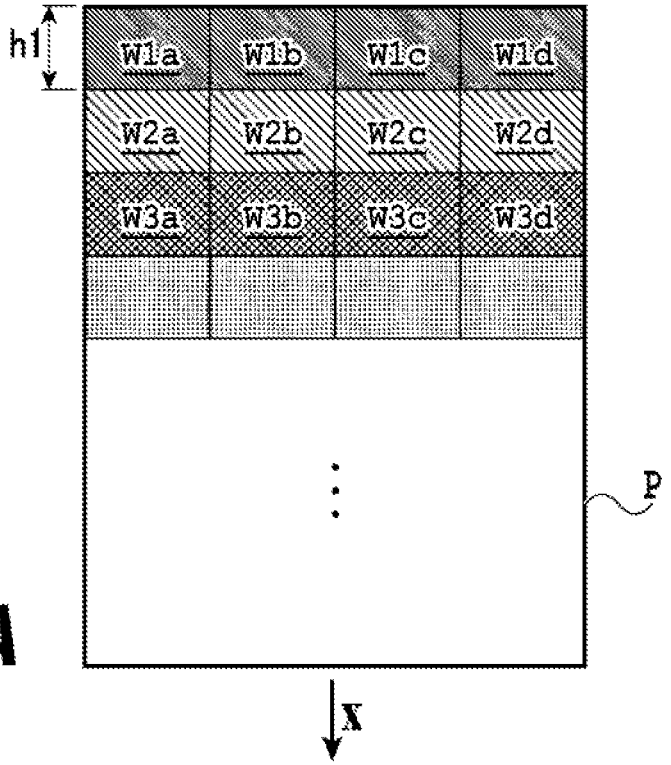
FIGS. 13A and 13B are explanatory diagrams for examples in other embodiments of the present invention where the relationship between the window and the print medium is different.
Figure 13B:
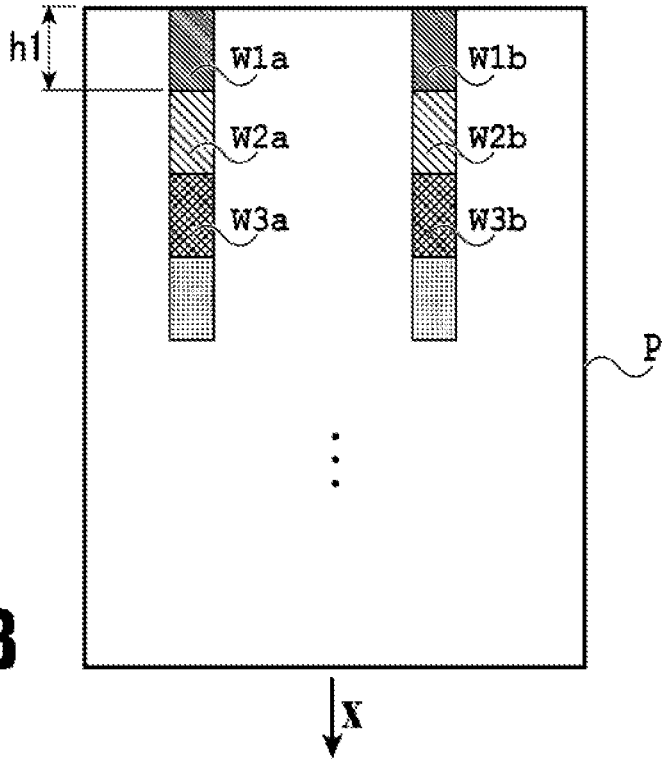

The pattern of the window W is not limited to the one in which the window W extends across the entire length of the print medium in the width direction as in the above embodiment. For example, in a case where the number of dots needs to be counted in specified print areas on the print medium because of the power supply system of a printing apparatus, the structure of the ink supply system, or the like, the pattern of windows may be the ones illustrated in FIGS. 13A and 13B. The windows W1*a* to W1*d*, W2*a* to W2*d*, and so on in FIG. 13A are a pattern in which the windows W1, W2, and so on are divided in the width direction of the print medium. The windows W1*a*, W1*b*, W2*a*, W2*b*, and so on in FIG. 13B correspond to two sections apart from each other in the width direction of the print medium in each of the windows W1, W2, and so on.

The present invention is not limited to full-line printing apparatuses using the full-line print heads described above but may be widely applied to various types of printing apparatuses including serial printing apparatuses using serial print heads. In a serial printing apparatus, an images is printed along with the print scanning of a serial print head in the main scanning direction and the operation of conveying the print medium in the sub-scanning direction intersecting the main scanning direction. For such serial printing apparatuses, the scanning speed of the movable print head is determined as the print speed, instead of the conveyance speed of the print medium in full-line printing apparatuses. For example, print data for one scanning is obtained, the print data is divided for each window, the number of the dots for each window is counted, and the scanning speed of the print head can be determined based on the count value.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-134263 filed Jul. 17, 2018, which is hereby incorporated by reference herein in its entirety.

What is claimed is:

1. A printing apparatus comprising:

a print head capable of forming dots on a print medium based on print data;

a movement unit configured to cause relative movement of the print head and the print medium in a specified direction; and a setting unit configured to, based on the print data, set a speed of the relative movement caused by the movement unit to a first speed in a case where the number of dots to be formed in an area of a specified size on the print medium is less than or equal to a threshold, and set the speed of the relative movement to a speed lower than the first speed in a case where the number of dots to be formed in the area of the specified size is more than the threshold, wherein the setting unit, in a case where the number of dots to be formed in an area of a first size on the print medium is more than the threshold, determines whether to set the speed of the relative movement to a second speed lower than the first speed, according to the number of dots to be formed in an area of a second size which is smaller than the area of the first size.

2. The printing apparatus according to claim 1, wherein the setting unit includes a first counting unit configured to count, as a first count value, the number of dots to be formed in each of the areas each having the first size into which the print medium is divided, and a second counting unit configured to count, as a second count value, the number of dots to be formed in each of the areas each having the second size into which the print medium is divided.

3. The printing apparatus according to claim 2, wherein (i) in a case where the area of the first size the first count value for which exceeds a first specified value is not included within a specified print range of the print medium, the setting unit sets the speed of the relative movement to the first speed, and (ii) in a case where the area of the first size the first count value for which exceeds the first specified value is included within the specified print range of the print medium, and where the area of the second size the second count value for which exceeds a second specified value is not included within the specified print range, the setting unit sets the speed of the relative movement to the second speed.

4. The printing apparatus according to claim 3, wherein (iii) in a case where the area of the first size the first count value for which exceeds the first specified value and the area of the second size the second count value for which exceeds the second specified value are included within the specified print range, the setting unit sets the speed of the relative movement to a third speed lower than the second speed.

5. The printing apparatus according to claim 3, wherein the first specified value and the second specified value are the same value.

6. The printing apparatus according to claim 1, wherein the printing apparatus has multiple print modes, and wherein the setting unit sets the speed of the relative movement for each of the print modes.

7. The printing apparatus according to claim 6, wherein the print modes include print modes having different print resolutions.

8. The printing apparatus according to claim 1, wherein the print head is an inkjet print head capable of ejecting ink based on the print data.

9. The printing apparatus according to claim 1, wherein the movement unit is configured to move the print medium in a first direction, and wherein the print head is a line print head extending in a second direction intersecting the first direction.

10. The printing apparatus according to claim 1, wherein the print head is a serial print head movable in a main scanning direction, wherein the movement unit moves the serial print head in the main scanning direction and conveys the print medium in a sub scanning direction intersecting the main scanning direction, and wherein the setting unit sets a speed of the movement of the serial print head in the main scanning direction caused by the movement unit.

11. The printing apparatus according to claim 1, wherein the area of the second size is smaller than the area of the first size in the specified direction.

12. The printing apparatus according to claim 11, wherein a width of the area of the first size in an intersection direction intersecting the specified direction is the same as a wide of the area of the second size in the intersection direction.

13. The printing apparatus according to claim 11, wherein a ratio in size in the specified direction between the area of the first size and the area of the second size corresponds to a ratio between the first speed and the second speed.

14. The printing apparatus according to claim 1, wherein the area of the first size includes the area of the second size.

15. The printing apparatus according to claim 1, wherein the area of the first size is an area of a size corresponding to the entire print medium, and wherein the area of the second size is an area of a size corresponding to a portion of the print medium.

16. A printing method comprising the steps of:

executing relative movement of a print head and a print medium in a specified direction, the print head being capable of forming dots on the print medium based on print data; and setting, based on the print data, a speed of the relative movement to a first speed in a case where the number of dots to be formed in an area of a specified size on the print medium is less than or equal to a threshold, and the speed of the relative movement to a speed lower than the first speed in a case where the number of dots to be formed in the area of the specified size is more than the threshold, wherein in the setting, in a case where the number of dots to be formed in an area of a first size on the print medium is more than the threshold, it is determined whether to set the speed of the relative movement to a second speed lower than the first speed, according to the number of dots to be formed in an area of a second size which is smaller than the area of the first size.

17. A non-transitory computer-readable storage medium having stored therein a program for causing a computer to execute a printing method of printing an image on a print medium using a print head capable of forming dots on the print medium based on print data, the printing method comprising the steps of:

executing relative movement of the print head and the print medium in a specified direction; and setting, based on the print data, a speed of the relative movement to a first speed in a case where the number of dots to be formed in an area of a specified size on the print medium is less than or equal to a threshold, and the speed of the relative movement to a speed lower than the first speed in a case where the number of dots to be formed in the area of the specified size is more than the threshold, wherein in the setting, in the case where the number of dots to be formed in an area of a first size on the print medium is more than the threshold, it is determined whether to set the speed of the relative movement to a second speed lower than the first speed, according to the number of dots to be formed in an area of a second size which is smaller than the area of the first size.

* * * * *